US008201614B2

(12) United States Patent
Yoshida et al.

(10) Patent No.: US 8,201,614 B2
(45) Date of Patent: Jun. 19, 2012

(54) METHOD AND AN APPARATUS OF CONTROLLING CHEMICAL COMPOSITION OF A MOLTEN METAL DURING CONTINUOUS CASTING

(75) Inventors: Hirokazu Yoshida, Tokyo (JP); Tsukasa Takazawa, Tokyo (JP); Shuji Tomimatsu, Tokyo (JP)

(73) Assignee: The Furukawa Electric Co., Ltd., Tokyo (JP)

( * ) Notice: Subject to any disclaimer, the term of this patent is extended or adjusted under 35 U.S.C. 154(b) by 25 days.

(21) Appl. No.: 12/745,518

(22) PCT Filed: Nov. 28, 2008

(86) PCT No.: PCT/JP2008/071726
§ 371 (c)(1),
(2), (4) Date: May 28, 2010

(87) PCT Pub. No.: WO2009/069782
PCT Pub. Date: Jun. 4, 2009

(65) Prior Publication Data

US 2010/0307711 A1 Dec. 9, 2010

(30) Foreign Application Priority Data

Nov. 30, 2007 (JP) ..... 2007-311616
Nov. 27, 2008 (JP) ..... 2008-302813

(51) Int. Cl.
*B22D 27/00* (2006.01)

(52) U.S. Cl. ..... 164/453; 164/4.1; 164/55.1; 164/451

(58) Field of Classification Search ..... 164/451, 164/4.1, 55.1, 453
See application file for complete search history.

(56) References Cited

U.S. PATENT DOCUMENTS 3,752,753 A * 8/1973 Fitterer ..... 156/89.12
4,555,662 A 11/1985 Doutre et al.

FOREIGN PATENT DOCUMENTS

JP 55-128353 A 10/1980
JP 58-65554 A 4/1983
JP 59-169654 A 9/1984

(Continued)

OTHER PUBLICATIONS

Bakhtiyarov et al, "Electrical conductivity measurements in liquid metals by rotational technique", Mar. 21, 1999, Springer Netherlands, Journal of Materials Science, vol. 34, Issue 5, pp. 945-949.*

(Continued)

*Primary Examiner* — Jessica L Ward
*Assistant Examiner* — Nicholas D'Aniello
(74) *Attorney, Agent, or Firm* — Birch, Stewart, Kolasch & Birch, LLP

(57) ABSTRACT

A method of controlling composition of a molten copper or a molten copper alloy during continuous cast, comprising the steps of determining continuously specific resistance of the molten copper or the molten copper alloy; calculating the composition of the molten copper or the molten copper alloy based on relationships between specific resistance of the molten copper or the molten copper alloy and each constituent which are preliminarily comprehended; and controlling the composition of the molten copper or the molten copper alloy based on the calculated composition. It is possible to consider temperature or content of dissolved oxygen to calculate the composition.

8 Claims, 5 Drawing Sheets

FOREIGN PATENT DOCUMENTS

| | | | |
|---|---|---|---|
| JP | 59-171834 | A | 9/1984 |
| JP | 5-277641 | A | 10/1993 |
| JP | 6-63710 | A | 3/1994 |
| JP | 8-300119 | A | 11/1996 |
| JP | 10-193059 | A | 7/1998 |
| JP | 2002-3964 | A | 1/2002 |
| JP | 2002-86251 | A | 3/2002 |
| JP | 2006-341268 | A | 12/2006 |

OTHER PUBLICATIONS

Kita et al., "Specific resistance measurement of molten Cu-In-Sn alloy", The summary of the speech in The Japanese Institute of Metals, vol. 86, p. 166, 1980.

* cited by examiner

METHOD AND AN APPARATUS OF CONTROLLING CHEMICAL COMPOSITION OF A MOLTEN METAL DURING CONTINUOUS CASTING

FIELD OF THE INVENTION

The present invention relates to a method and an apparatus of controlling chemical composition of a molten metal during the continuous casting of copper alloy material.

BACKGROUND OF THE INVENTION

The manufacturing process (A) as described below is known as the most popular method of casting copper alloy. At first, copper row material, scrap and addition elements or mother alloy including the addition elements are put in a melting furnace (an electrical furnace or a gas furnace) and then melted. Then, after all of the materials are melted, a sample for analysis is collected from the molten metal in the furnace. The chemical composition of the molten metal is determined by chemical analysis or instrumental analysis. The chemical composition is modified to be a desired chemical composition. Then, after the chemical composition is identified as desired, the casting of the copper alloy is carried out.

As the other case, there is a method in which alloy elements are added during transferring molten pure copper. The following methods are listed among them as the method (B) that adds solid, for example:

a. In the SCR method for copper alloy wire or the Contirod casting method, additional elements are added between the melting furnace and the casting machine to cast copper alloy with a prescribed composition (for instance, refer to Patent document 1).

b. A continuous casting apparatus comprises an adding tub and an adding crucible at the end of the casting line, which casts copper or copper alloy, and heat indirectly the molten metal in the crucible (for instance, refer to Patent document 2).

c. In the continuous alloy casting method comprising the steps of melting metal in a melting furnace, transferring the metal to a tub and casting with a casting mold, the tub has a retaining portion for the molten metal, and granular alloy elements are continuously thrown into the molten metal on the retaining portion (for instance, refer to Patent document 3).

d. A continuous manufacturing apparatus of copper alloy comprises a heating furnace, wherein the heating furnace comprises the first adding means to add alloy elements, and a tundish down the heating furnace where molten copper is put in through a tub (for instance, refer to Patent document 4).

In other case, there are some methods (C) that molten metal are added during transferring molten pure copper. Some cases of the methods (C) are mentioned below.

e. Alloy elements are semi-molten or molten, and dropped to molten metal above a tundish during continuous casting. Thereby the chemical composition of an alloy are controlled, and homogenous molten metal is produced (for instance, refer to Patent document 5).

f. The molten copper is held in a tundish in the continuously casting high conductive copper alloy, and Ni—P compound is added to the molten copper (for instance, refer to Patent document 6), in. a method of continuously casting high conductive copper alloy, g. A method of continuously casting alloy is that wires comprising alloy elements are continuously molten or semi-molten by arc discharge, and are added to molten base metal (for instance, refer to Patent document 7).

Moreover, there is known a chemical composition controlling method during continuously casting that electrical resistances of roughing wire are measured continuously, and the electrical resistances are used for feedback control. The method is that the adding of alloy elements are continuously controlled with the measured electrical resistances of roughing wire when conductive alloy is casted and rolled continuously by means of continuously adding additive elements to the molten metal (for instance, refer to Patent document 8).

Specific resistance of molten metal is generally known. For instance, in Data Book of Metal compiled by Japan Society of Mechanical Engineers, specific resistance of pure metal is described. The specific resistance of molten pure metal is greater than these of the pure metals in room temperature (refer to the Table 1 mentioned below).

TABLE 1

Comparison of Specific resistance

| | Solid substance | | Molten substance | | |
|---|---|---|---|---|---|
| Elements | Temperature (degrees C.) | Specific resistance (μ ohm cm) | Temperature (degrees C.) | Specific resistance (μ ohm cm) | Melting Point (degrees C.) |
| Cu | 20 | 1.67 | 1100 | 20.2 | 1083 |
| Ni | 20 | 6.84 | 1454 | 85.0 | 1453 |
| Si | 20 | $2.3 \times 10^{23}$ | 1410 | 82.0 | — |
| Sn | 20 | 12.6 | 1000 | 67.0 | 232 |

In addition, it is described that the specific resistance of copper alloy is changed as a function of mixing ratio between Sn and In (refer to Non Patent document 1). However it is not described to control chemical composition of copper alloy with the use of the above knowledge.

In recognizing the importance of the electrical characteristics of molten metal, there is described a method of detecting inclusions in the molten metal (especially aluminum alloy) (for instance, refer to Patent document 9). This method is to detect a decreasing amount of cross-sectional area of current pathway. That is, the method is not to detect the change of specific resistance as a function of the composition of molten metal in the current pathway.

Moreover, in the multi layer manufacturing method (F), electrical characteristics are applied to continuous casting (for instance, refer to Patent document 10). This method is one to continuously make a multi layer metal material, which has inner layer and surface layer; wherein the chemical composition of the inner layer is different from that of the surface layer. In the method, supply of the two metals in unit time is controlled with specific resistance of the metal in a mold so that the position of the boundary between the inner layer and the surface layer, which is determined with the specific resistance, is correspond to a specific position.

[Patent document 1] Japanese Patent Application Publication No. Shou 55-128353 (1980-128353)

[Patent document 2] Japanese Patent Application Publication No. Hei 06-063710 (1994-063710)

[Patent document 3] Japanese Patent Application Publication No. Hei 10-193059 (1998-193059)

[Patent document 4] Japanese Patent Application Publication No. 2006-341268

[Patent document 5] Japanese Patent Application Publication No. Shou 59-169654 (1984-169654)

[Patent document 6] Japanese Patent Application Publication No. Hei 08-300119 (1996-300119)

[Patent document 7] Japanese Patent Application Publication No. 2002-86251

[Patent document 8] Japanese Patent Application Publication No. Shou 58-065554 (1983-065554)

[Patent document 9] Japanese Patent Application Publication No. Shou 59-171834 (1984-171834)

[Patent document 10] Japanese Patent Application Publication No. Hei 05-277641 (1993-277641)

[Non Patent document 1] "Specific resistance measurement of molten Cu—In—Sn alloy", Kita, Morita and Matsumoto, The summary of the speech in The Japanese Institute of Metals, Vol. 86, p. 166, 1980

SUMMARY OF THE INVENTION

In the method such as the method (A) in which electrical copper, other pure metals, mother alloy of the above metals and recycled waste-metal, the composition of which is known as slitting waste yielded in a production process or edge waste derived from the both end, are molten by melting furnaces, it is necessary to wash the furnaces more than once in order to avert the interfusion of the prior product when various kinds of alloy are produced in limited amounts. Thus, this method yields great energy loss, and is inefficient.

In order to avoid washing furnaces, the method (B) and (C) were developed. In these methods, it is not necessary to wash furnaces, and it is able to produce various kinds of alloy in limited amounts. But the composition of an alloy can be assured only by means of the composition analysis of the yielded alloy because there has been no method of controlling the composition of the alloy after adding alloy elements. In the methods (B) and (C), large amount of composition defect are often yielded when, for instance, addition element materials are lodged and stopped during transferring.

In order to solve the above problem, the method (D) was developed, but the distance between the adding position and the measuring position is far apart, and therefore because there is a time to transfer the materials, the feedback control cannot be accurately carried out. Moreover, a continuous casting and rolling method such as the method (D) is influenced by the rolling temperature. For instance, when the rolling temperature is low, in solid solution alloy, electrical conductivity becomes low due to accumulation of processing strain in the alloy material, and meanwhile in precipitation-hardened alloy, electrical conductivity becomes high due to development of deposition. Therefore along with the above methods (B) and (C), automated control does not function depending on a rolling finished temperature, and in the result, a large amount of waste in composition are often yielded.

Electrical characteristics of molten metal are known generally, and utilized on composition assessments of molten metal and measurement of inclusions. Particularly, inclusion detecting method of the method (E) is used industrially utilizing the characteristics. But the methods are used only for quality certification, and aren't used during casting. Other methods such as the method (F) are used only in particular cases.

When various kinds of alloy are produced in limited amounts, it is effective to add alloy elements to a mother alloy during continuously casting in order to minimize changeover loss in changing products, that is, furnace washing. But there are various controlling method in adding alloy elements, and however the composition of the alloy is controlled only with the use of the alloy product after casting, and therefore it is not able to assure the whole of the alloy product. In the present invention, it is an object to manufacture the whole of an ingot of copper alloy with homogenous alloy composition when the copper alloy is continuously cast. Furthermore, it is another object to reduce changeover loss by means of continuously controlling amount of additive elements in changing products.

In order to solve the above problems, the inventors found out a casting method of controlling composition of an alloy with the use of the relationship between the composition and the measured specific resistance of molten copper and molten copper alloy.

According to the present invention, there are provided the means as mentioned below:

(1) A method of controlling chemical composition of molten metal during continuous casting, comprising the steps of:

continuously determining specific resistance of molten copper and molten copper alloy;

calculating the chemical composition of the molten metal based on relationship between specific resistances and amount of constituents which is preliminarily prepared; and correcting the chemical composition of the molten copper alloy based on a calculated result.

(2) The method of controlling chemical composition of molten metal during continuous casting according to (1), which further comprises the step of continuously determining temperature of the molten copper and the molten copper alloy; wherein the chemical composition is calculated based on the relationship including the temperature.

(3) The method of controlling chemical composition of molten metal during continuous casting according to (1) or (2), which further comprises the step of continuously determining concentration of dissolved oxygen in the molten copper and the molten copper alloy; wherein the chemical composition is calculated based on the relationship including the concentration of dissolved oxygen.

(4) An apparatus of controlling chemical composition of molten metal during continuous cast comprising:

a measurement means for continuously determining specific resistance of molten copper and molten copper alloy;

a calculating means for calculating the chemical composition of the molten metal based on relationship between specific resistances and amount of constituents which is preliminarily prepared; and a correcting means for correcting the chemical composition of the molten copper alloy based on a calculated result.

(5) The apparatus of controlling chemical composition of molten metal according to (4), which further comprises a measurement means for continuously determining temperature of the molten copper and the molten copper alloy; wherein the calculating means calculates the chemical composition of the molten metal based on the relationship including the temperature.

(6) The apparatus of controlling composition of a molten copper or a molten copper alloy according to (4) or (5), which further comprises a measurement means for continuously determining concentration of dissolved oxygen of the molten copper and the molten copper alloy; wherein the calculating means calculates the chemical composition of the molten metal based on the relationship including the concentration of dissolved oxygen.

The above and other features and advantages of the present invention will become more apparent from the following detail description with reference to the suitable accompanying drawings.

BEST MODE FOR CARRYING OUT THE INVENTION

Figure 1:
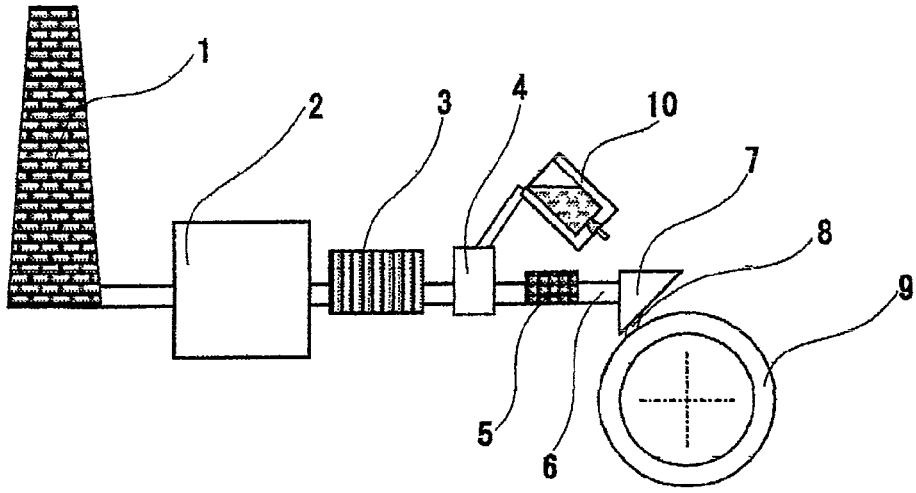
FIG. 1 is an outline setup of an example of the melting apparatuses and the continuous casting and rolling apparatuses to which the present invention is applied.

Various examples of embodiments of the method and the apparatus of controlling chemical composition of a molten metal according to the present invention are described hereunder. The same reference numeral represents the identical element in each drawing.

At first, general background of the fundamental technology is described concerning the embodiments of the present invention. A high-temperature ingot of copper and dilute copper alloy, which is higher or equal to 800 degrees C., is cast with the use of a moving casting mold with a belt and a wheel or with twin belts, and is hot-rolled continuously by means of a hot rolling mill. Soot, which is generated by means of imperfect combustion of ethylene, is repeatedly deposited on the inner surface of the moving casting mold. Therefore, the lost of heat quantity is stably prevented, and furthermore, an ingot is prevented from sticking to the moving casting mold. In this process, it is very important that the temperature of the ingot is maintained high in order to keep the solution state even in the continuous casting and rolling of a precipitation hardened copper alloy. When the temperature of the ingot is low, the ingot is heated up by means of an induction heating apparatus before or during hot rolling. The inventors of the present invention already proposed this method in Japanese Patent Application No. 2007-146226.

Figure 2:
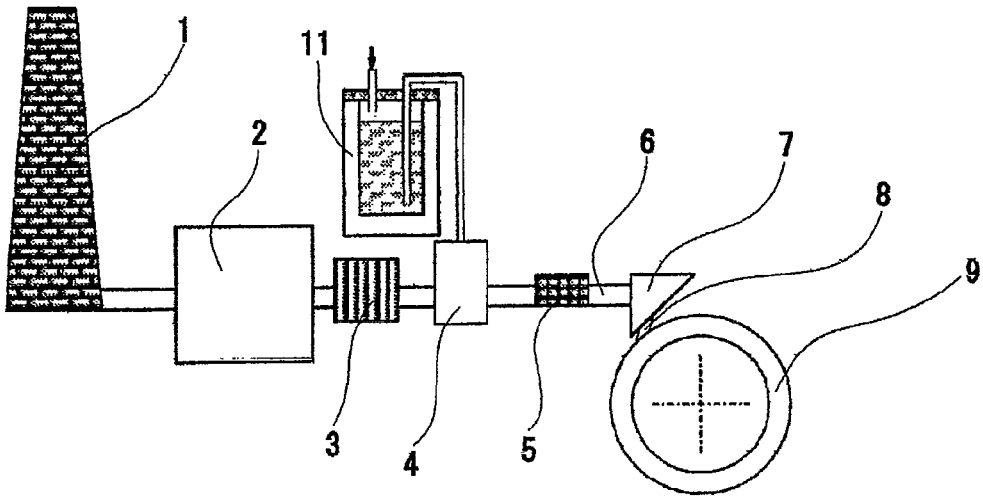
FIG. 2 is an outline setup of another example of the melting apparatuses and the continuous casting and rolling apparatuses to which the present invention is applied.

FIGS. 1 and 2 depict an example of the process of the melting apparatus and the continuous casting and rolling apparatus to which the present invention is applied, more specifically, a schematic view of an example of the continuous casting apparatus using a belt and wheel type moving casting mold (following hot rolling mill and quenching apparatus are not shown.). As shown in FIGS. 1 and 2, raw copper is molten at a temperature of 1090 degrees C. to 1150 degrees C. in a shaft furnace 1; then molten pure copper is transferred from the shaft furnace 1 to a retaining furnace 2; then the molten copper in the retaining furnace 2 is kept at a temperature of 1100 degrees C. to 1200 degrees C.; and then the molten copper in the retaining furnace 2 is transferred to a converging unit (a mixing tank) 4. It is preferable to arrange a deoxygenation and dehydrogenation unit 3 between the retaining furnace 2 and the converging unit 4.

Then highly-concentrative molten metal including alloy elements, which flows out from a tilting type melting furnace 10 (refer to FIG. 1) or a pressing type melting furnace 11 (refer to FIG. 2) for additive elements, is added to the molten pure copper in the converging unit 4, and then the chemical composition of the molten copper alloy is adjusted to a desired composition. It is able to produce a specific amount of the alloy with the use of one melting furnace for additive elements, and more optimally, it is able to produce more amount of the alloy by means of using two or more melting furnaces in alternate shifts.

The molten alloy is continuously transferred from the converging unit 4 into the casting pot 7 through the tub 6 with the filter 5, and then the molten alloy in the casting pot 7, which is sealed with inert gas or reducing gas, is solidified by means of pouring to a belt and wheel casting machine 9 as the moving casting mold through the casting spout 8. A prescribed copper alloy material can be manufactured from the solidified ingot by means of a continuous hot rolling mill (not shown in the figure) under the condition of keeping the temperature of the ingot as high as possible, which is preferably from 900 degrees C. to 950 degrees C., although there is no upper limit of the temperature. The copper alloy material may be formed to bar material and plate material besides wire material.

The above described deoxygenation process is carried out by means of the well-known method such as causing to contact the molten metal with glowing charcoals. In this method, oxygen in the molten metal comes to carbon dioxide gas by means of reacting chemically with the grain charcoals, and then the carbon dioxide gas floats up in the molten metal, and is released to the air. The dehydrogenation process is carried out by means of the well-known method such as causing to contact the molten metal with non-oxygenated gas, inert gas and reducing gas. The dehydrogenation process can be carried out after or simultaneously with the deoxygenation process.

It is able to continuously cast for a long period of time by means of a melting furnace, which has the same melting capacity as the casting capacity of a continuous casting apparatus. The melting furnace comprises a moving mold with a belt and a wheel such as a vertical continuous casting apparatus and SCR, and with twin belts such as Contirod apparatus. For instance, SCRs have generally a casting (productive) capacity of 15 ton per hour to 50 ton per hour, thus very large amount of facility investment is necessary to have an electric melting furnace with a productive capacity substantially the same as the above. A melting specific consumption is large if all of metal materials are to be molten only with the use of electric power. Moreover, such demerits as the increase of the processing cost as well as the large amount of the emitting carbon dioxide come out. Therefore, in order to avoid the above described demerits, the copper material except the recycled scrap copper is melted in a gas furnace (i.e., a reverberating furnace or a shaft furnace) to improve the melting specific consumption.

On the other hand, additive elements are melted in a melting furnace, which is an exclusive electric melting furnace, to prepare highly-concentrative molten metal. When a highly-concentrative molten metal is produced, additive elements such as Ni, Co, Si, and Sn, or mother alloys including these additive elements are poured into a melting furnace at the same time. Heat of mixing is yielded rapidly in the melting furnace when heated above 1100 degrees C., and in addition, locally, the temperature in the melting furnace comes to be at least 1600 degrees C. This heat is transferred to the neighboring Si and so on, to break surface oxide film of the Si due to the thermal expansion, and thus the materials is easily melted. Therefore, the reduction treatment of Si comes to be unnecessary, and it is able to use inexpensive Si material. Additionally, this heat of mixing can be utilized to melt the neighboring Ni, Si or the like, and therefore, necessary input energy for melting can be significantly reduced.

The highly-concentrative molten metal, which have been completely molten, are mixed with molten pure copper, and therefore, molten copper alloy is produced.

In order to improve accuracy of controlling an amount of the highly-concentrative molten metal flowing out from a melting furnace for additive elements, the following methods are developed;

(1) Controlling the amounts of the flowing molten metals by means of measuring an amount of the flowing molten metal passing through a measuring tub, which has a triangular weir or a quadronangular weir in the way to the converging unit (the mixing tank) over which the molten metal flows;

(2) Controlling the amounts of the flowing molten metals by means of measuring specific resistance of the molten copper alloy instead of measuring the composition of the alloy after the highly-concentrative molten metals and are made uniformly-dispersed in the molten pure copper by means of beating up with mechanical power or with bubble at the converging unit, which the highly-concentrative molten metals and the molten pure copper converge.

The amounts of the flowing molten metals are controlled by means of feedbacks of one or both of the above measured values.

Figure 3:
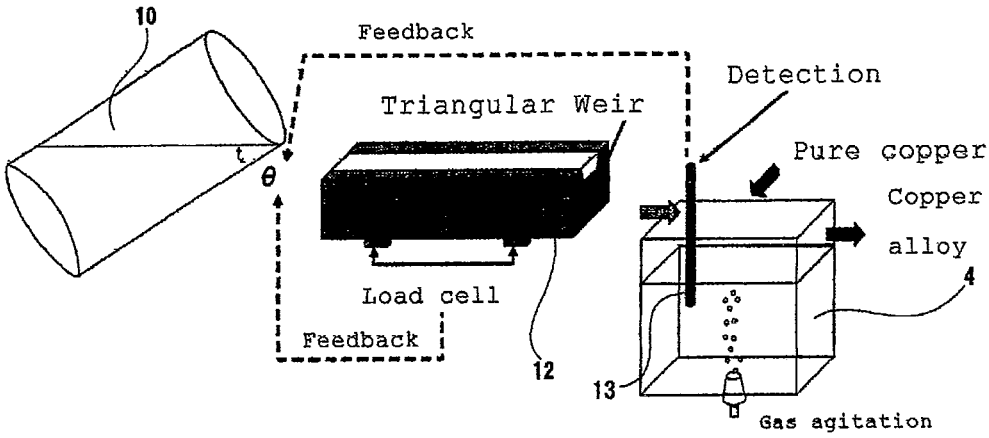
FIG. 3 is an explanatory diagram showing the method of controlling an amount of molten metal flowing out from a tilting type melting furnace for additive elements.
Figure 4:
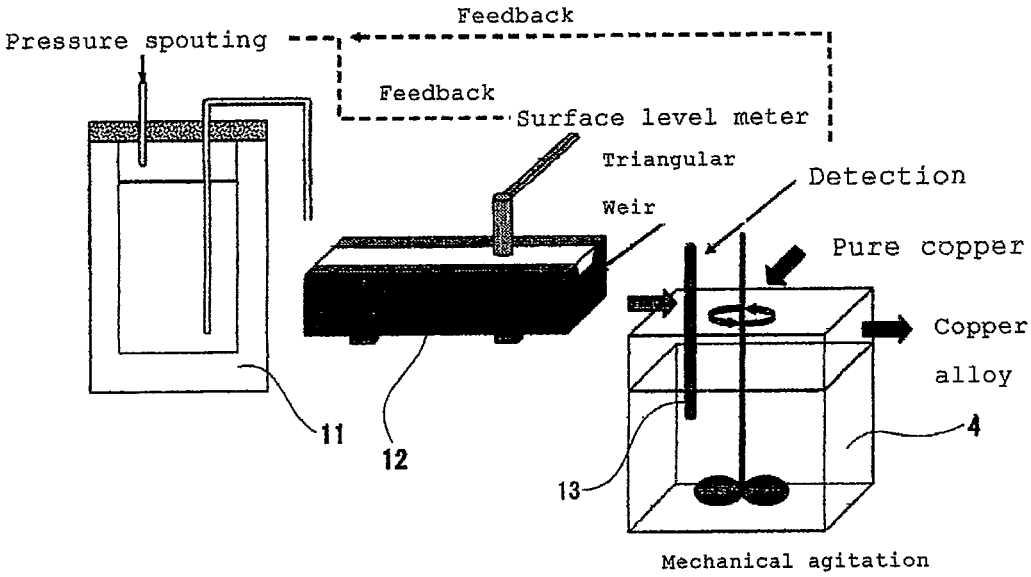
FIG. 4 is an explanatory diagram showing the method of controlling an amount of molten metal flowing out from a pressing melting furnace for additive elements.

There is not limited means for measuring an amount of a molten metal in a measuring tub 12. For instance, a load cell as shown in FIG. 3 or a liquid-level gage as shown in FIG. 4 can be utilized. A passing amount of molten metal is calculated from the amount of a molten metal by means of the method corresponding to Japanese Industrial Standard (JIS) K0094-8. A relationship between an amount of a molten metal and a tilting angle of a tilting type melting furnace for additive elements can be preliminarily determined with a past operating record. A relationship between an amount of a molten metal and an injection rate of pressing gas injected in a pressing melting furnace for additive elements can be determined in advance with the result of the production in trial operation.

The highly-concentrative molten metal with constituents adjusted to be various rate in advance is added to the pure molten copper to obtain the specific resistance, thus the chemical composition of the alloy can be determined with the use of specific resistance. The reason simply comes from the fact that the relationship between specific resistance and the composition of molten copper alloy which includes Ni, Co and Si has high linearity.

As shown in FIG. 3, some load cells on the measuring tub 12 are connected to a tilting angle changing unit through the control unit. The amount of a molten metal flowing out from the melting furnace 10 for additive elements is controlled by means of changing the tilting angle depending on the measured values of the load cells with the use of feedback control. Alternatively, as shown in FIG. 4, some liquid-level gages on the measuring tub 12 are connected to an injection rate changing unit of the pressing gas in the pressure type melting furnace 11 for additive elements through the control unit. The amount of a molten metal flowing out from the melting furnace for additive elements is controlled by means of changing the injection rate depending on the measured values of the liquid-level gages with the use of feedback control. Moreover, it is able that the highly-concentrative molten metal flowing out from the melting furnaces are accumulated in a ladle and so on. The flow rates of the molten metal are controlled with the use of needle valves or sliding gates. However, this method is not preferable because the number of the producing facilities increases.

Moreover, as shown in FIGS. 3 and 4, the electric resistance measuring instrument 13 on the converging unit is connected to a tilting angle changing unit or an injection rate changing unit of the pressing gas through the control unit. The amount of the highly-concentrative molten metal flowing out from a melting furnace can be controlled by means of changing the tilting angle or the injection rate depending on the specific resistance values with the use of feedback control.

Figure 5:
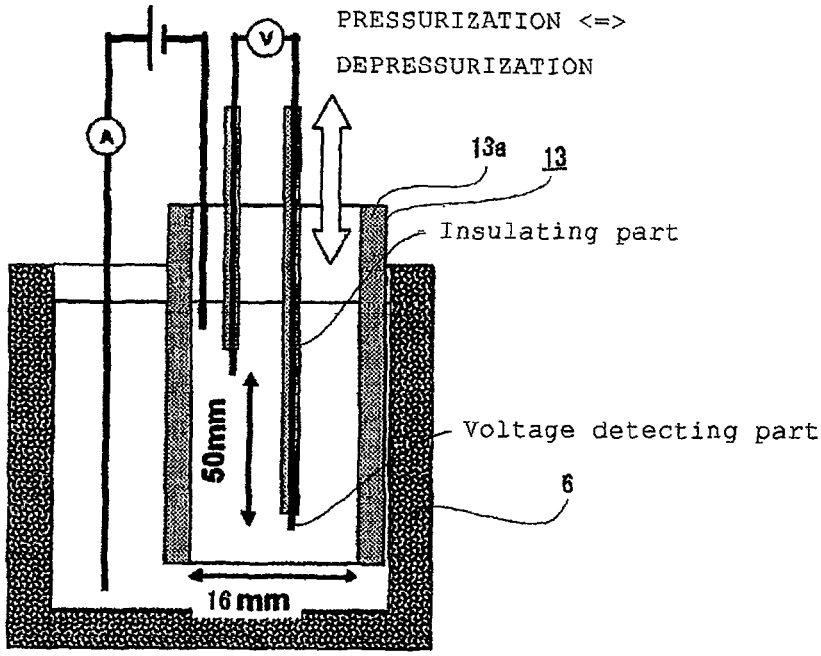
FIG. 5 is an outline setup of an example of a detector of a measurement instrument for specific resistance arranged in a molten metal.
Figure 6:
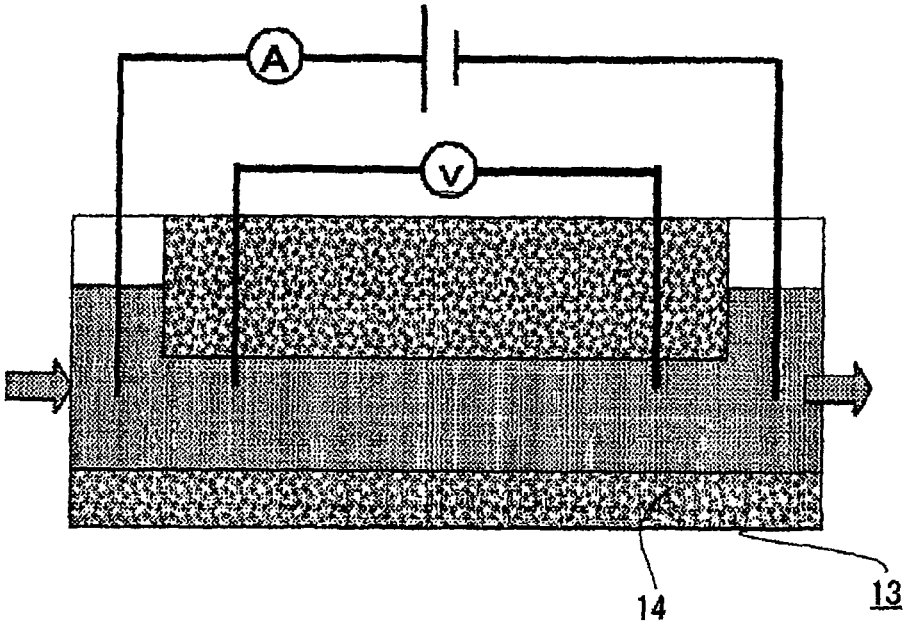
FIG. 6 is an outline setup of another example of a detector of a measurement instrument for specific resistance arranged in a molten metal.

As shown in FIGS. 5 and 6, it is also able to control an amount of a molten metal flowing out from a melting furnace for additive elements by means of feedback of specific resistance values which are measured by the electric resistance measuring instrument 13 set in the tub 6, where the molten alloy flows, instead of the converging unit (the mixing tank).

Moreover, it is also able to control an amount of a molten metal flowing out from a melting furnace for additive elements with parallel use of one feedback control based upon an amount of a molten metal in the measuring tub 12 and another feedback control based upon specific resistance.

The feedback unit measures and accounts cumulatively from a weight or a volume measured at the measuring tub 12 for a tilting cycle time of the tilting type melting furnace for additive elements 10. In the case that the weight is not equal to a specific weight, a setting angle of the tilting unit is increased or decreased in order to increase or decrease a tilting angle of the tilting type melting furnace at the next time. A relational equation for the control of tilting is calculated in advance from the relationship between the tilting angle of the tilting type melting furnace and an amount of the highly-concentrative molten metal flowing out from the tilting type melting furnace. Next, averaged composition is obtained, which is calculated from the electric resistance measured for a period of greater than or equal to two times of the tilting cycle time by means of the measuring instrument 13. In the case that the averaged composition is not equal to a specific composition, a setting angle of the tilting unit is increased or decreased in order to increase or decrease a tilting angle of the tilting type melting furnace at the next time.

In the process that copper alloy is continuously produced by means of adding solid elements, liquid elements or the mother alloy, which includes additive elements, in the route of transferring molten copper, the specific resistance of molten pure copper and molten copper alloy is measured by means of continuously measuring specific resistance. The composition of the molten copper alloy is calculated by an elementary calculator with the use of the predetermined relationship between the specific resistance of each constituent and an amount of each constituent. For instance, the specific resistance of molten pure copper is used for a blank test. The amounts of additive elements, the kind of additive element and the amount of molten copper are modified based upon the result by the means as mentioned above. The composition of the alloy is compensated to a specific composition of the alloy by means of feedback control.

Furthermore, in the case that some kind of inclusions, especially oxidative products are dispersed in the molten copper alloy, and have conductivity such as $SnO_2$, it was determined from our experimental results that specific resistance is affected depending on an amount of the oxidative products. Therefore, a temperature and/or an amount of dissolved oxygen in the molten copper alloy are simultaneously measured at the position of measuring specific resistance by means of, for instance, a thermo couple or a zirconia gas oxygen analyzer, which is in a concentration cell type with zirconia. It is able to improve the measurement accuracy furthermore by means of calculation of an amount of the contents in the molten copper alloy from specific resistance and from temperature and/or an amount of dissolved oxygen. That is, content of Sn can be calculated with the use of the following correcting equation (1) concerning, for instance, tough pitch coppers including Sn. The equation (1) is changed depending on a kind of alloy elements.

$$[\mathrm{Sn}] = \frac{\rho - 0.003 \times [O] - 0.008 \times T + 21.1}{1.990} \quad (1)$$

[Sn]: Content of Sn in the molten copper alloy (wt %)
σ: Specific resistance (μΩcm)
[O]: Content of dissolved oxygen (ppm)
T: Temperature of molten copper alloy (K)

Furthermore, when it is necessary to control conductivity of copper alloy at the room temperature, the conductivity can be generally calculated with the use of the following equation (2) from content of Sn and dissolved oxygen calculated with the use of the equation (1).

$$(\text{Conductivity at the room temperature}) = q(\text{Content of element}, \text{Content of dissolved oxygen}) \quad (2)$$

When copper alloys are produced by means of a vertical continuous casting apparatus or a continuous casting apparatus having a moving mold such as SCR and Contirod, the specific resistance of molten copper alloy and molten pure copper are continuously measured by means of specific resistance measuring instruments. It is possible to manufacture ingots with entirely homogenous composition by means of controlling the amounts of additive elements based upon the measured results. Moreover, when various kind of ingots are continuously manufactured in small amounts by means of the above apparatuses, it is possible to reduce excess eliminations of faulty portion because a portion with a specific composition is identified clearly by means of sensors as mentioned above. As a result, the loss at changeover of product variety, which includes loss for washing furnace, can be minimized.

More specifically, the measuring instruments are set up on a small retaining tub at the downstream side of the point where pure metals of additive elements such as Sn, Cr and Zn, which are major additive elements, or mother alloy such as 15% Si—Cu, 50% Mg—Cu and 50% Ti—Cu are added to the molten copper during transferring the molten copper. There, the specific resistance of the molten copper alloy is measured. Although the specific resistance can be measured simply and most accurately by means of the 4-terminal method, the specific resistance can be measured by other methods such as the eddy-current method.

Examples of typical measuring instrument and general arrangement thereof are shown in FIGS. 5 and 6.

As shown in FIG. 5, the detector 13*a* of the measuring instrument 13 has cylindrical geometry with one closed end. In this case, it enables to set to interchange molten metal in the detector 13*a* by means of the repetition of applying pressure, which makes liquid level lower in the detector 13*a*, and discharging, which makes liquid level up in the detector 13*a*, because it is necessary that the molten metal in the detector 13*a* is fresh state at every moment. The feature as shown in FIG. 5 comprises simple structure because the fresh molten metal flows into the detector 13*a* without the pressure reduction due to a static pressure of the molten metal.

The measuring instrument as shown in FIG. 6 includes also the flowing pass of the molten metal, which is a portion of the tub 6 for instance, in itself. In this case, a pressing unit is not necessary. By the way, the structural object of the measuring instrument 13, which is shown as the identical symbol 14 in FIG. 6, is made from refractory materials having good insulation property such as alumina. However it does not always have to be a burned product such as an alumina tube and a silica tube.

Figure 7:
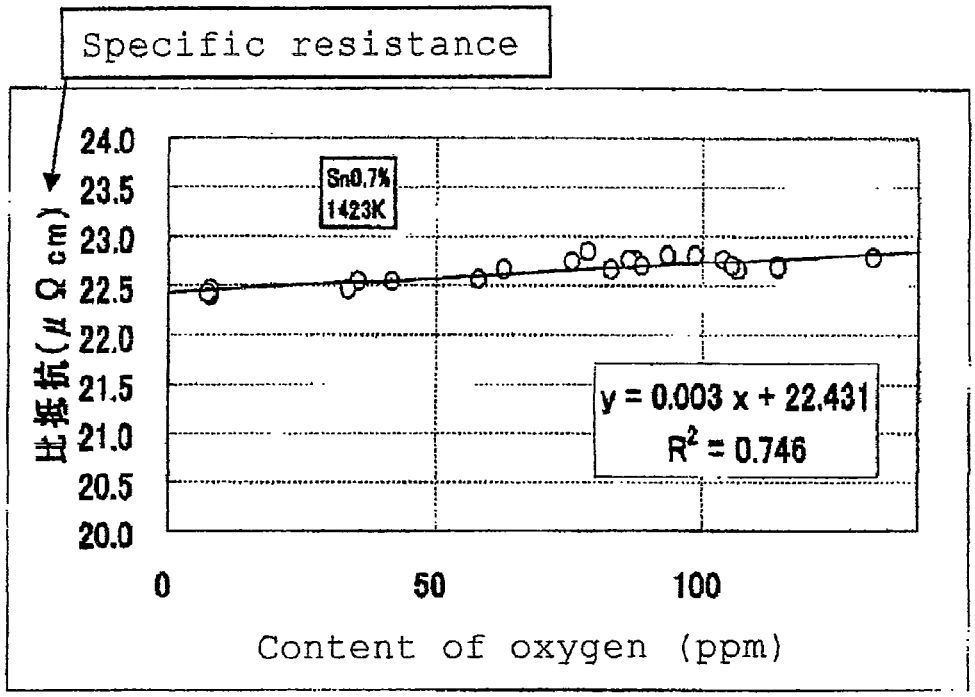
FIG. 7 is a graph showing a relationship between specific resistance of a molten metal and a content of oxygen in the molten metal.

According to the chemical composition, some inclusions are made from a portion of the major contents due to oxidization or carbonization. These inclusions are generally insulating substance. However, some of the inclusions are conductive. For instance, in the case that a rate of oxygen content in copper alloy with Sn is 100 to 500 ppm. It is well-known that most of Sn forms into $SnO_2$, and the melting point of the $SnO_2$ is 1126 degrees C., and therefore, solid oxides are derived if the temperature of the molten metal is below the melting point, and liquid oxides are derived if the temperature is above the melting point. Since phase of these oxides and a rate of oxide content affect specific resistance of the molten metal more greatly than temperature dependence of specific resistance (refer to FIG. 7), the composition of molten copper alloy is determined by means of calculating with the use of the equation (1) not only from specific resistance, but also from the temperature and rate of oxide content of the molten copper alloy which are measured at the same time of measuring specific resistance. Furthermore, conductivity of a copper alloy product such as a roughing wire is calculated with the use of the equation (2) from the above measured values.

In addition, in the case that the measurement point of specific resistance of molten metal is unusually close to the adding point of additive elements, it is necessary to homogenize the molten metal by means of stirring with the aim of the followings:

(1) A measured specific resistance indicates a value to the whole molten metal even if the molten metal is a mixture of two kind of molten metals.

(2) For instance, in the case of Colson alloy, the oxidized film is to be broken, which are derived from combination of oxygen in the molten metal and Si, which has an affinity to oxygen.

For the above purposes, gas bubbling is applied to the molten metal. Necessary stirring energy is greater than or equal to 30 W/m$^3$, and more preferably stirring energy is greater than or equal to 100 W/m$^3$. However, the stirring energy may be up to 400 W/m$^3$.

The stirring energy (ε:W/m$^3$) by gas bubbling is calculated with the use of the following equation (3), which is described by Mori, Sano and etc in the journal of Tetsu-to-Hagane, Vol. 67, p. 672-695, 1981.

$$\varepsilon = \frac{6.18 \times V_g \times Tl}{Vl} \times \left[\ln\left\{1 + \frac{ho}{1.46 \times 10^{-5} \times Po}\right\} + \eta \times \left(1 - \frac{To}{Tl}\right)\right] \quad (3)$$

Vg: gas flow rate Nm$^3$/min, VI: Volume of molten metal in ladle m$^3$
TI: Temperature of molten metal K, Tg: Temperature of gas K
ho: Blowing depth of gas m, Po: Surface pressure of molten metal Pa,
η: Contributing coefficient (=0.06)

Meanwhile, in mechanical stirring, necessary stirring energy is greater than or equal to 20 W/m$^3$, and more preferably stirring energy is greater than or equal to 100 W/m$^3$.

However, the stirring energy is up to 400 W/m$^3$. The stirring energy ($\epsilon$:W/m$^3$) is calculated with the use of the following equation (4).

$$\varepsilon = \frac{T \times \omega}{Vl} \tag{4}$$

Figure 8:
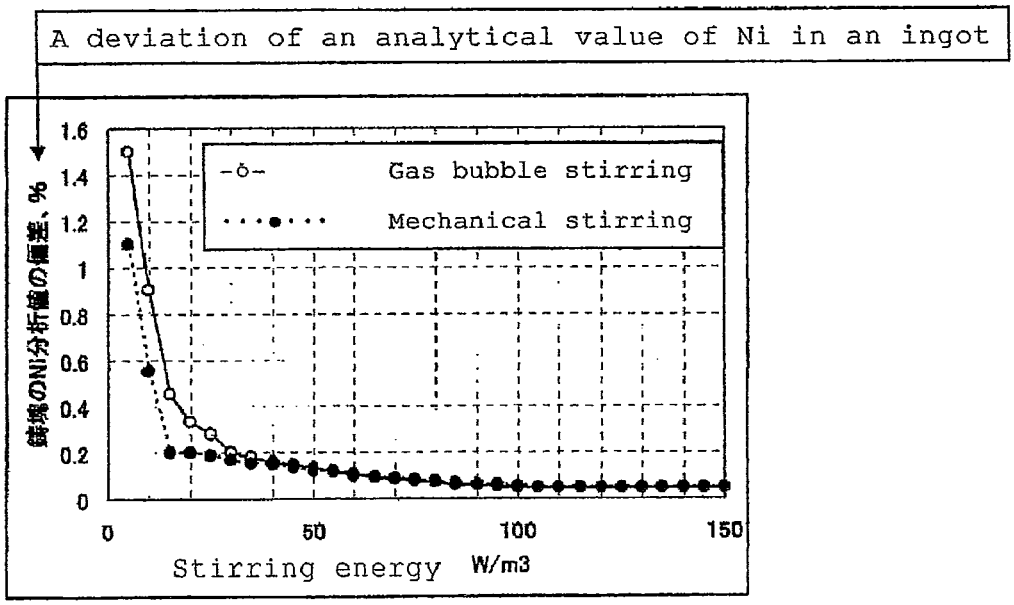
FIG. 8 is a graph showing a relationship between a power for agitating a molten metal and a content of Ni in a produced ingot.

T: Rotary torque W·s, ω: Rotating angular speed rad/s,
VI: Volume of molten metal in ladle m$^3$ FIG. 8 is a graph showing a relationship between an energy for stirring a molten metal and variation of a content of Ni in the produced ingot.

It is desirable to measure specific resistance of molten metal by means of the 4-terminal method with the use of direct current or pulse current as shown in FIGS. 5 and 6. In addition, the specific resistance can also be measured with the use of eddy-current. In this case, considering a high temperature in contrast to the case of aluminum; in addition, the setting of current applying terminals, voltage applying terminals and the insulator of these terminals, the cross-section of current path is preferably a circle having a diameter of preferably larger than or equal to 8 mm and more preferably larger than or equal to 11 mm. With the above described cross-section, it is possible to stably measure specific resistance for long period of time. The upper limit of the diameter in the cross-section of current path is not necessarily defined, however, usually the current path has a diameter of less than or equal to 20 mm. In addition, it is determined that specific resistance can be used for feedback control of the contained amount of Ni and Si, because Ni and Si included in molten metal have high linearity between the constituents and the specific resistance.

According to the present invention, it is possible to manufacture molten copper alloy with Sn and molten Colson alloy massively, inexpensively, easily and stably by means of continuously or intermittently adding molten metal having a high concentration of additive elements, which includes Sn in the case of copper alloy with Sn, and which includes Ni, Si and so on in the case of Colson alloy, during transferring molten pure copper which is molten by means of a shaft furnace. In addition, on the grounds that inexpensive row materials can be used because there is not strict limit on row materials of Si and so on, that heat of mixing reduces a melting specific consumption, that washing a furnace is not very necessary in the process of transferring molten copper, and that it is easy to change kinds of products, it is possible to supply stably copper alloys with a specific composition at low cost. Moreover the melting facilities can be downsized, and therefore it is possible to reduce investment in facilities.

According to the present invention, when copper alloys such as Colson alloy are manufactured by means of a continuous casting apparatus such as a vertical continuously casting apparatus, a belt and wheel casting apparatus and a twin belt continuously casting apparatus, it is possible to manufacture ingots with entirely homogenous composition.

In addition, even if a specific composition is changed sequentially, it is possible to reduce loss at changeover of kinds of products, that is, washing furnace by means of control of an amount of additive alloy elements, and therefore it is easy to change kinds of products.

Furthermore, when molten metals are manufactured by means of batch melting process with the use of a large-sized furnace and continuously casting process with the use of a horizontal continuously casting apparatus, an amount of high affinity elements with oxygen such as Zr are decreased gradually with time due to oxidization. But according to the present invention, even in the case, it is possible to control the composition of the molten metal by means of measuring a temporal loss of Zr and adding a slight amount of Zr with the use of, for instance, wire-feeder method.

EXAMPLES

The present invention is described more in detail by the example hereunder. In order to simplify the description, in this example, there is described the example in which the measuring instrument 13 as shown in FIG. 5 is applied to the continuous casting and rolling apparatus as shown in FIG. 1 which manufactures copper alloy including Sn, that is, tough pitch copper including Sn. However the present invention is not limited to the above example.

Tough pitch copper including a content of 0.7% Sn, which includes 200 ppm concentration of oxygen, is manufactured by means of SCR having a casting capacity of 20 ton/hour. Shots of Sn with a diameter of 1 mm are added in the molten metal transferring tub 6 at the interval of 30 seconds piece by piece. The detector 13*a* of the measuring instrument 13, which is made of an alumina tube with a inner diameter ø of 16 mm, is immersed from above in the pot down the adding position of Sn, and molten metal in the detector 13*a* is interchanged by means of repeat of adding pressure in the detector 13*a* with $N_2$ gas and exhausting, that is, setting back to atmosphere pressure.

In this example, the measuring is performed with the use of the detector immersed in the pot during continuously casting.

More specifically, the specific resistance is calculated from voltage value measured with the use of 4-terminal method, and content of Sn is calculated from the specific resistance with the use of the equation (1) by means of a calculator.

Next, if there is a difference between the content of Sn and a specific content, and when the difference is developed gradually, an inflow of molten metal gets changed, and therefore, an adding amount of Sn shot is made changed automatically in order to correct the difference.

And when the difference is yielded rapidly, it is recognized that any troubles occur to the Sn shot adding apparatus, and an alert about facility trouble is announced. Or an auxiliary apparatus adds automatically Sn shots.

As described in Japanese Patent Application Publication No. 59-171834, if an alumina tube of the measuring instrument has a maximum inner diameter ø of 5 mm, it is necessary to aspirate the tube, that is, the reduction of the pressure down to below atmosphere pressure, and therefore the construction and maintenance of the measuring instrument come to be complicated. Since the measuring instrument 13 of this embodiment requires only pressurization, it is easy to handle the measuring instrument.

Figure 9:
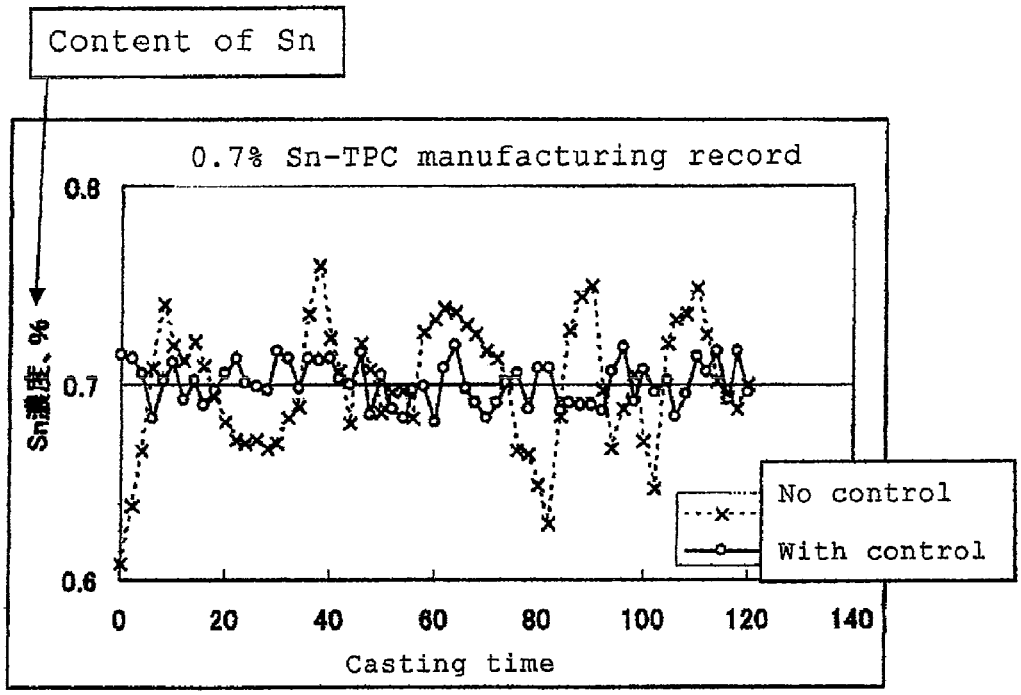
FIG. 9 is a graph showing a content of Sn fluctuating during casting in the embodiments.

The results of the above measurement are shown in FIG. 9. When the content of Sn in molten metal is controlled based upon the results measured by means of the measuring instrument 13, the content is an average 0.699% and a standard deviation 0.032% before automatic control, and an average 0.700% and a standard deviation 0.010% after automatic control, and the fluctuation of content is reduced significantly.

By the way, specific resistance calculated from measuring results may have variety due to the fluctuation of work dimensions such as distance and cross-sectional area of edge of the detector in the measuring instrument. In the case, it is preferable to correct as the followings:

a. At first, specific resistance of pure copper before manufacturing alloy is measured, and the measured specific resistance is corrected so that the measured specific resistance is equal to the known value.

b. A sample for analysis obtained from molten copper is analyzed in respect to composition, and the measured specific resistance is corrected by means of reverse operation from a known content value.

INDUSTRIAL APPLICABILITY

According to the present invention, when copper alloys such as Colson alloy are manufactured by means of a continuous casting apparatus such as a vertical continuously casting apparatus, a belt and wheel casting apparatus and a twin belt continuously casting apparatus, it is possible to manufacture ingots with entirely homogenous composition.

In addition, even if a specific composition is changed sequentially, it is possible to reduce loss at changeover of kinds of products, that is, washing furnace by means of control of an amount of additive alloy elements, and therefore it is easy to change kinds of products.

While the present invention has been described above with reference to the embodiments and example thereof, it is apparent that the description does not limit all of the present invention except as otherwise noted, and the present invention should be understood broadly without departing from the scope of the added claim and the concept This patent application claims priority to Japanese Patent Application No. 2007-311616 that was filed on Nov. 30, 2007 in Japan, and Japanese Patent Application No. 2008-302813 that was filed on Nov. 27, 2008 in Japan. The subject matters of these patent applications are incorporated by reference in their entirety herein.

What is claimed is:

1. A method of controlling a chemical composition of a molten copper alloy in continuous casting, comprising the steps of:

providing at least one molten alloying element at a high concentration, adding said at least one molten alloying element to pure molten copper at a variously set known ratio, to obtain a respective specific resistance of a first molten copper alloy, thereby obtaining a relationship between a chemical composition of the first molten copper alloy and the specific resistance of the first molten copper alloy, the first molten copper alloy containing said at least one molten alloying element at a given concentration;

continuing to add the at least one molten alloying element to the pure molten copper to form a second molten copper alloy;

continuously determining a specific resistance of the second molten copper alloy during continuos casing;

calculating the chemical composition of the second molten copper alloy, based on the obtained relationship the determined specific resistance of the second molten copper alloy and an amount of said at least one molten alloying element; and adjusting the chemical composition of the second molten copper alloy, based on the calculated chemical composition of the second molten copper alloy, by changing the amount of said at least one molten alloying element being added.

2. The method of controlling a chemical composition of a molten copper alloy in continuous casting according to claim 1, which further comprises the step of:

continuously determining a temperature of the second molten copper alloy, to determine the amount of said at least one molten alloying element;

wherein, in the calculating step, the chemical composition of the second molten copper alloy is calculated, based on the relationship, together with the determined temperature.

3. The method of controlling a chemical composition of a molten copper alloy in continuous casting according to claim 1, which further comprises the step of:

continuously determining a concentration of dissolved oxygen in the second molten copper alloy, to determine the amount of said at least one molten alloying element;

wherein, in the calculating step, the chemical composition of the second molten copper alloy is calculated, based on the relationship, together with the determined concentration of dissolved oxygen.

4. The method of controlling a chemical composition of a molten copper alloy in continuous casting according to claim 2, which further comprises the step of:

continuously determining a concentration of dissolved oxygen in the second molten copper alloy, to determine the amount of said at least one molten alloying element;

wherein, in the calculating step, the chemical composition of the second molten copper alloy is calculated, based on the relationship, together with the determined concentration of dissolved oxygen.

5. The method of controlling a chemical composition of a molten copper alloy in continuous casting according to claim 1, which further comprises the steps of:

(1) measuring an amount of the said at least one molten alloying element passing through a measuring spout, which measuring spout has a triangular weir or a rectangular weir in the mid way to a converging unit where the said at least one molten alloying element is converged with the pure molten copper; and (2) measuring the specific resistance of the second molten copper alloy, under an agitating power provided by a mechanical agitator or a bubble agitator to said at least one molten alloying element and the pure molten copper at the converging unit, and providing the result in (1) and (2) as feedback with respect to the chemical composition of the second molten copper alloy, thereby controlling the amount to be added of said at least one molten alloying element.

6. The method of controlling a chemical composition of a molten copper alloy in continuous casting according to claim 1, wherein, in the step of continuously determining a specific resistance of the second molten copper alloy, the specific resistance of the second molten copper alloy is measured, at a converging unit where said at least one molten alloying element is converged with the pure molten copper, through a control unit.

7. The method of controlling a chemical composition of a molten copper alloy in continuous casting according to claim 1, wherein, in the step of continuously determining a specific resistance of the second molten copper alloy, the specific resistance of the second molten copper alloy is measured, at a spout through which the second molten copper alloy flows, through a control unit.

8. The method of controlling a chemical composition of a molten copper alloy in continuous casting according to claim 1, wherein the step of continuously determining a specific resistance of the second molten copper alloy, is conducted by:

(3) changing a tilting angle of a melting furnace of a tilting type for said at least one molten alloying element, with the melting furnace of a tilting type being connected with a control unit to control a feedback of the specific resistance, or (4) changing an injection volume of a pressurized gas of a melting furnace of a pressure pouring type for said at least one molten alloying element, with the melting furnace of a pressure pouring type being connected with a control unit to control a feedback of the specific resistance, thereby providing the changed result in (3) or (4) as the feedback with respect to the chemical composition of the second molten copper alloy, thereby controlling the amount to be added of said at least one molten alloying element.

* * * * *